US006384764B1

(12) United States Patent
Cumberland

(10) Patent No.: US 6,384,764 B1
(45) Date of Patent: May 7, 2002

(54) INFLATABLE RADAR REFLECTOR

(76) Inventor: Todd Cumberland, 3629 Serra Rd., Malibu, CA (US) 90265

( * ) Notice: Subject to any disclaimer, the term of this patent is extended or adjusted under 35 U.S.C. 154(b) by 0 days.

(21) Appl. No.: 09/484,133

(22) Filed: Jan. 14, 2000

(51) Int. Cl.[7] ..... H01Q 15/20
(52) U.S. Cl. ..... 342/8; 342/9; 342/10
(58) Field of Search ..... 342/5, 8, 9, 10

(56) References Cited

U.S. PATENT DOCUMENTS

| | | | | |
|---|---|---|---|---|
| 2,619,303 A | | 11/1952 | Martin | |
| 2,888,675 A | | 5/1959 | Pratt et al. | |
| 3,181,158 A | | 4/1965 | Feldman | |
| 3,229,291 A | | 1/1966 | Dell'Aria et al. | |
| 3,613,097 A | * | 10/1971 | Daughenbaugh | 244/142 X |
| 3,617,113 A | * | 11/1971 | Hoyer | 359/847 |
| 3,721,983 A | | 3/1973 | Sherer | |
| 3,727,229 A | | 4/1973 | Clinger et al. | |
| 4,028,701 A | * | 6/1977 | Parks et al. | 342/8 |
| 4,044,711 A | | 8/1977 | Jamison | |
| 4,120,259 A | * | 10/1978 | Wilson | 116/124 B |
| 4,673,934 A | * | 6/1987 | Gentry et al. | 342/8 |
| 4,901,081 A | * | 2/1990 | Bain, Jr. et al. | 342/8 |
| 4,980,688 A | * | 12/1990 | Dozier, Jr. | 342/9 |
| 5,129,323 A | * | 7/1992 | Park | 102/293 |
| 5,285,213 A | * | 2/1994 | Tusch | 343/915 |
| 5,424,741 A | * | 6/1995 | Genovese | 342/10 |
| 5,457,472 A | | 10/1995 | Bjordal et al. | |
| 5,682,172 A | | 10/1997 | Travers et al. | |
| 5,695,894 A | | 12/1997 | Clube | |
| 5,733,030 A | * | 3/1998 | Cohn et al. | 362/34 |
| 5,814,754 A | * | 9/1998 | Mangolds | 89/1.11 |
| 5,940,023 A | * | 8/1999 | Hintzke et al. | 342/5 |
| 5,969,660 A | * | 10/1999 | Veazey | 342/8 |

FOREIGN PATENT DOCUMENTS

| | | | | |
|---|---|---|---|---|
| EP | 0507632 A1 | * | 4/1992 | H01Q/15/20 |
| GB | 1 502 100 | * | 4/1992 | H01Q/19/10 |

* cited by examiner

*Primary Examiner*—John B. Sotomayor
(74) *Attorney, Agent, or Firm*—Brian B Shaw, Esq.; Stephen B. Salai, Esq.; Harter, Secrest & Emery LLP

(57) ABSTRACT

A radar detectable balloon includes an inflatable envelope with several planar radar-reflecting surfaces. Prior to inflation, the balloon may be collapsed into a compact flat configuration. When inflated, the radar reflective planar faces arranged in such a way that the largest angle formed by every line of sight and a normal to at least one planar face is less than 45°.

24 Claims, 3 Drawing Sheets

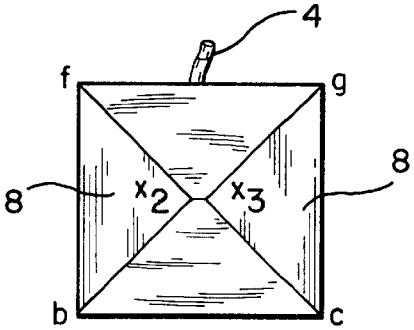
FIG. 5
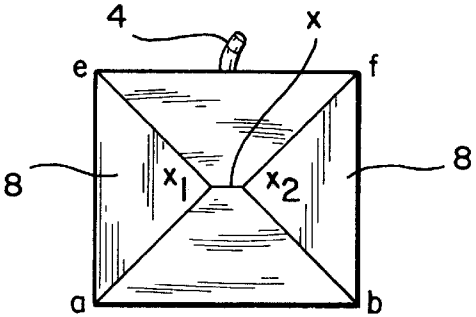
FIG. 6
FIG. 7
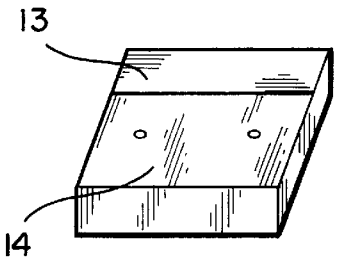
FIG. 8
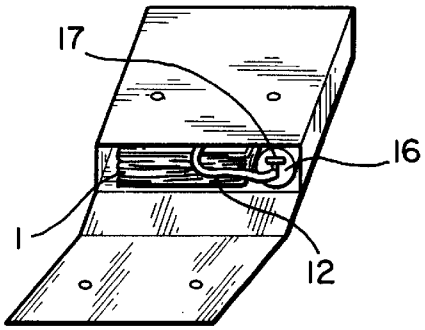
FIG. 9
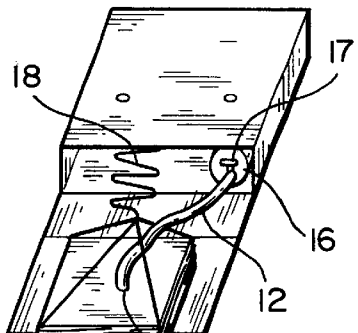
FIG. 10

INFLATABLE RADAR REFLECTOR

FIELD OF THE INVENTION

The present invention relates to a radar detectable balloon. The balloon includes an envelope which, when inflated, includes radar reflective planar faces arranged to efficiently reflect radar. When the envelope is not inflated, it assumes a compact, collapsed configuration. The balloon device may be incorporated in a kit, including an inflator for the balloon, for use in rescue operations or the marking of selected locations.

BACKGROUND OF THE INVENTION

U.S. Pat. No. 2,619,303 discloses a signal buoy balloon which when inflated assumes a spherical shape. The balloon itself is impregnated with metallic material so that the balloon may be detected by electrical search means such as conventional radar apparatus. However, the curved surfaces of spherical or ovoid shaped balloons do not efficiently reflect radar.

U.S. Pat. No. 3,181,158 discloses a water-borne distress unit that includes a balloon whose envelope when inflated assumes a hexahedral configuration and acts as a radar reflector by virtue of a metallized surface. The hexahedral configuration of the balloon is also relatively inefficient at reflecting radar signals.

U.S. Pat. Nos. 2,888,675, 3,299,291, 4,901,081 and 5,457,472 disclose various multi-faceted radar reflectors. However, the reflectors are enclosed within a distinct envelope which is pervious to radar. Such constructions are complicated, requiring the reflectors to be attached to the internal surfaces of the balloon envelope.

SUMMARY OF THE INVENTION

According to a first embodiment, this invention provides a radar detectable balloon device comprising an inflatable envelope, wherein when inflated the envelope includes at least six radar reflective planar faces arranged in such a way that the largest angle formed by every line of sight and a normal to at least one planar face is less than 45°.

According to another embodiment, the balloon device comprises an inflatable envelope, wherein when inflated the envelope comprises at least eight radar reflective planar faces.

The envelope may include two polyhedral chambers, for example, chambers having pyramidal configurations. Such chambers are preferably joined at or near an apex of side facets of the pyramidal chambers. The chambers may be fluidly connected, and proximate pairs of edges of side facets of the pyramidal chambers may be joined by radar reflective webbing.

Additionally, this invention provides a kit comprising the balloon device, along with an inflator for selectively inflating the envelope with lighter than air fluid. The kit may further include a tether connected to the balloon device, and a storage pouch for storing the balloon device in a deflated condition, the inflator, and the tether. The storage pouch preferably has a weight that is greater than the buoyancy force of balloon device when inflated with the lighter than air fluid, to thereby serve as an anchor for the inflated device. The pouch may be sized to be easily retained within the pocket of a jacket. Alternatively, it may be incorporated into a flotation device or life raft.

BRIEF DESCRIPTION OF THE DRAWINGS

FIG. 5 is a bottom plan view of FIG. 4.

FIG. 6 is a front plan view of FIG. 4.

FIG. 7 is a side plan view of FIG. 4.

FIGS. 8 to 12 illustrate a kit of this invention and operation thereof.

DETAILED DESCRIPTION OF THE PREFERRED EMBODIMENT

Figure 1:
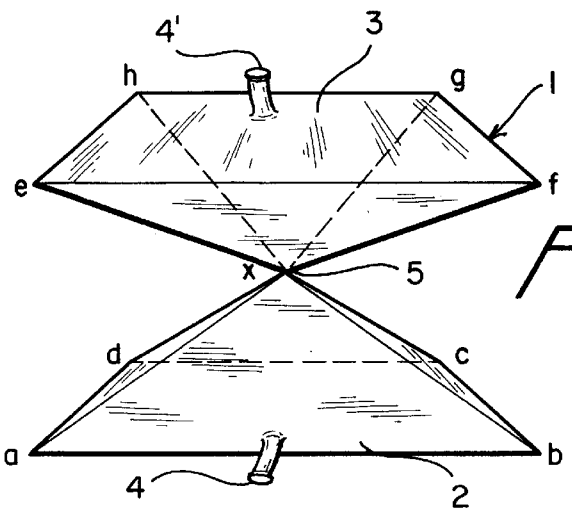
FIG. 1 is a schematic perspective view of a first embodiment of this invention.

A first embodiment of this invention is represented in FIG. 1, which shows a schematic view of the inflated balloon 1. In this embodiment, the balloon may be visualized as consisting of two opposed square pyramidal chambers 2, 3, where first square pyramidal chamber 2 is defined by comers abcdx, and second square pyramidal chamber 3 is defined by comers efghx. The chambers 2, 3 are joined at their common apex, or juncture, x. Accordingly, each chamber 2, 3 includes two square surfaces, and four triangular surfaces that meet at juncture 5, defined by point x.

Each angle formed by the planar surfaces meeting at each of corners a, b, c, d, e, f, g and h is less than ninety degrees. Preferably, the entire balloon 1, and each surface thereof, is formed of a radar reflective material, such as a flexible material foil or a flexible plastic film with a metallized surface. Such an arrangement provides efficient radar reflection. Additionally, use of a flexible material for the balloon ensures that the described embodiment assumes a very compact configuration prior to inflation. Referring to FIG. 1, it will be appreciated that balloon 1, in its collapsed state, assumes an essentially planar configuration.

In this embodiment, the joining of the two square pyramidal chambers 2, 3 at juncture 5 defined by point x allows for no shared volume between the two chambers. Therefore, chambers 2, 3 act as two independent chambers as far as the inflating gas is concerned. Accordingly, each of chambers 2, 3 includes an opening or valve 4, 4', respectively, for the introduction of an inflating gas. Optionally, juncture 5 of chambers 2,3 may have the form of a bearing that permits the two chamber to rotate freely with respect to each other, for example, in response to air currents.

Figure 2:
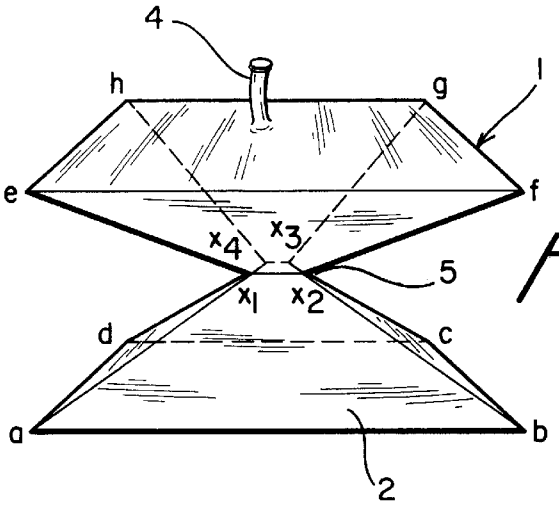
FIG. 2 is a schematic perspective view of a second embodiment.

An alternate embodiment is shown schematically in FIG. 2. In this embodiment, each of the two chambers 2, 3 is truncated a slight distance short of its apex, such that juncture 5 has the form of a quadrilateral opening between the two chambers and defined by four points $x_1$, $x_2$, $x_3$ and $x_4$. Accordingly, only one opening or valve 4 for introduction of an inflating gas is needed, as the aperture at juncture 5 permits the simultaneous inflation of the two chambers 2, 3.

Figure 3:
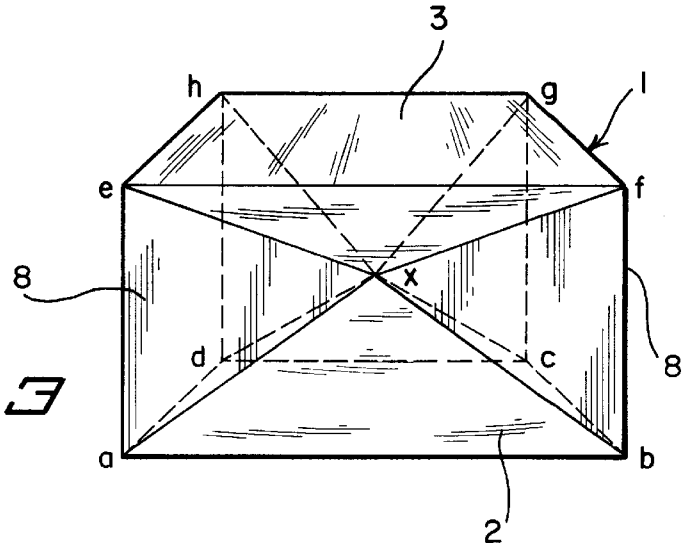
FIG. 3 is a schematic perspective view of a third embodiment.

A third embodiment is shown schematically in FIG. 3. This embodiment is similar to the embodiment illustrated in FIG. 1, with the addition of areas of webbing 8 which serve to stabilize and strengthen the dual-pyramid structure. In the illustrated embodiment, four such webs are present covering, respectively, the areas aex, bfx, cgx and dhx. As well as providing increased structural integrity, the four webs may also be constructed of similar radar reflective material to therefore provide eight additional reflecting surfaces, at different angles from those already provided by the facets of the inflated chambers. The web material would normally be identical with that of the inflatable chambers, although any compatible material with suitable lightness and reflectivity would suffice. Similar to the embodiments shown in FIGS. 1 and 2, use of a flexible radar reflective material permits this embodiment, in its collapsed state, to assume an essentially planar configuration.

Figure 4:
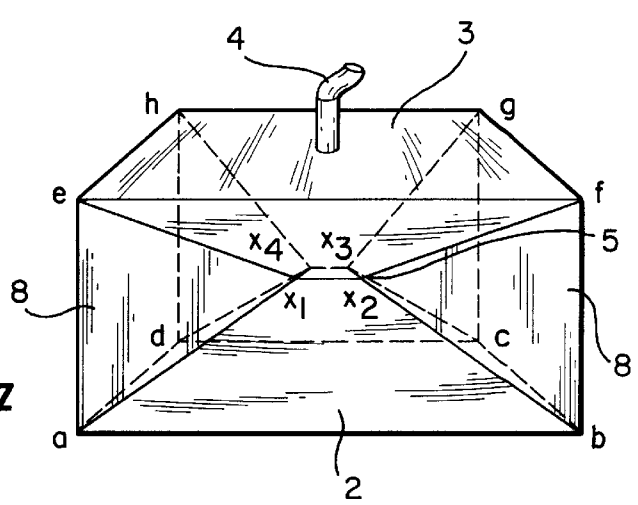
FIG. 4 is a schematic perspective view of a fourth embodiment.

A fourth embodiment is shown schematically in FIG. 4. This embodiment has a configuration similar to that of FIG. 2, but additionally includes four areas of webbing 8 added to strengthen and stabilize the truncated configuration. In this configuration, the four webs cover, respectively, the areas $aex_1$, $bfX_2$, $cgx_3$ and $dhx_4$.

FIGS. 5 to 7 illustrate the various surfaces of the embodiment of FIG. 4. FIG. 5 is a bottom plan view of FIG. 4, showing the base abcd of square-pyramidal chamber 2. The balloon of this embodiment includes a second base efgh of the other square pyramidal chamber 3. FIG. 6 is a front plan view of FIG. 4, showing four additional facets $abx_1x_2$, $efx_1x_4$, and the two facets $bfx_2$ and $aex_2$ provided by areas of webbing 8. The rear plan view would include four similar facets. In projection, the facet boundaries $ax_1$, $bx_2$, $ex_1$ and $fx_2$ are essentially orthogonal to each other. In other words, the line $x_1x_2$ of aperture 5 is relatively small, and if replaced by a single point x, the four facets therefore become triangles meeting at the shared apex x. Each such triangular facet would appear in projection to come to a 90° angle at the apex x. However, if such a facet were viewed normally, the angle at this apex x would be less than 90° to an extent which would be determined by the exact geometry of the inflated chamber. FIG. 7 is a right plan view of FIG. 4, showing four additional facets, where the left plan view would include four similar facets, with the facet boundaries being essentially orthogonal to each other.

Additional embodiments are possible in which the chambers are other than square-pyramidal in configuration, provided that the balloon in its inflated state will always have at least one external facet whose plane is within 45° of the perpendicular to the normal line of vision. In all the embodiments which have been described up to this point, the chambers are essentially pyramidal with four-sided bases. For pyramidal shaped chambers with triangular shaped bases, the number of reflecting surfaces is correspondingly smaller. On the other hand, pyramidal type chamber with bases having more than four sides would create more surfaces, but as the number of base sides increases, the resulting structures would increasingly resemble a cylinder and would therefore tend to lose reflective efficiency.

The shape of the individual chambers need not be limited to a pyramidal structure. For example, each chamber may be octahedral in shape This would add to the number of planar surfaces but would also increase the complexity of fabrication. Another embodiment may involve joining two or more pairs of the pyramidal chambers base to base, rather than point to point, with appropriate apertures between them to allow inflation from a single valve.

Yet other embodiments may include structures similar to previously described embodiments, except that in such embodiments the chambers, instead of coming together at a shared aperture or point, would be separated by a finite distance. Depending on whether the chambers were required to be inflated through a common inlet valve or individual valves, they may be linked with a length of compatible tubing, or with appropriately configured webbing.

All configurations of the balloon of this invention are structured so that in the inflated state, the angular separation of multiple pairs of facets is less than 90°, regardless of whether they physically intersect. Therefore, the balloon in its inflated state always has at least one facet whose plane is within 45° of the perpendicular to the normal line of vision.

The complexity and expense of fabricating the balloon can be minimized by cutting material according to a predetermined pattern to provide for as many surfaces as possible to originate from one piece. Thus, several facets junctures may be formed by folds rather than a seam. In any event, it may be desirable to strengthen folds and seams forming the facet junctures to protect against the possibility of over-inflating the balloon. This may be done, for example, by employing reinforcement tubing along the length of a fold or seam. The area of the aperture 5 may also be reinforced by a short length of compatible tubing.

Any seams in the envelope material, and the interface between the envelope material and the aperture reinforcement tubing if present, may be sealed by the use of appropriate adhesive, or by heat welding. It is not strictly necessary that the envelope and web material be radar-reflective prior to fabrication of the balloon, since it is possible to subsequently apply a reflective coating. Generally, however, it is more economical to use fabrication techniques which are compatible with an already reflective material.

As mentioned, the material of the chambers and of the webbing is sufficiently thin, strong and flexible that in the non-inflated condition the entire balloon may assume an essentially planar configuration. Accordingly, the balloon is preferably formed of a radar reflective foil or flexible material such as a plastic film with a metallized surface.

The present invention also provides an emergency kit that includes the radar reflective balloon. FIGS. 8 to 12 schematically illustrate an s emergency kit in various stages of deployment. For the described embodiment, the kit includes a balloon having the configuration of FIG. 4.

Figure 11:
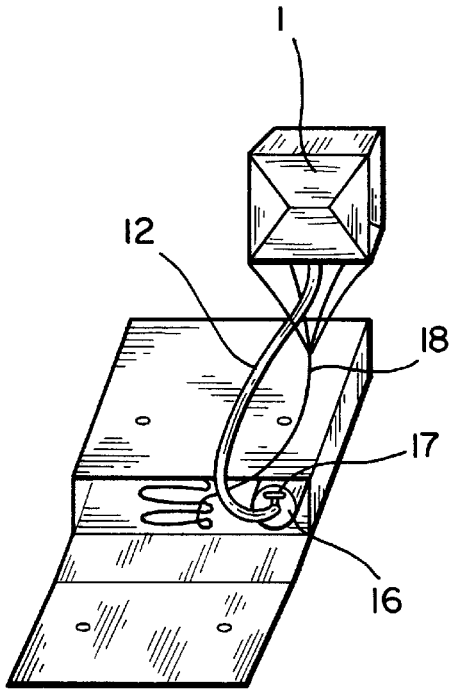
Figure 12:
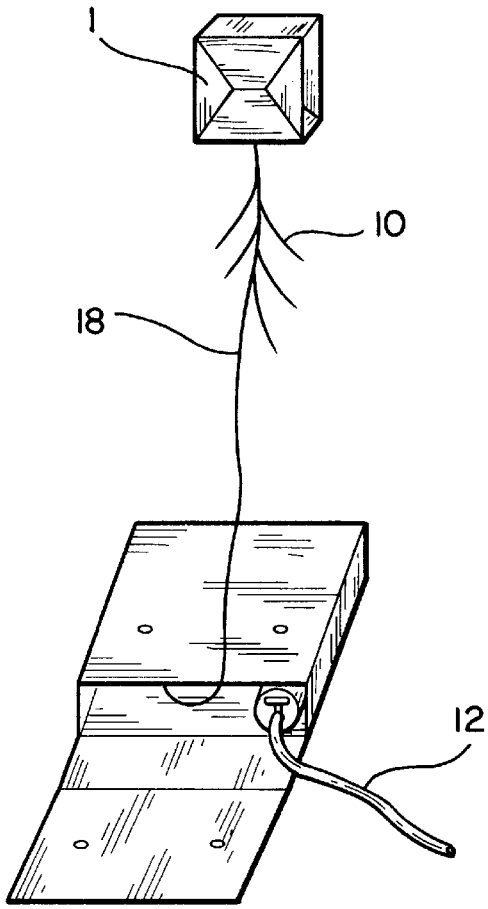

FIG. 8 illustrates a storage pouch 13 closed with a flap 14 which is fastened by suitable clasps, snaps or other means. FIG. 9 illustrates the flap 14 opened to reveal the collapsed balloon 1 still inside the pouch 3 alongside a fluid storage canister 16. The canister 16 is connected with the balloon through a shutoff 17 and a length of flexible fluid supply tubing 12. FIG. 10 illustrates the folded balloon withdrawn from the pouch, the attachment of the flexible tubing 2 to the one-way valve 4, and a tether 18 which is attached to four corners at one end of the balloon. FIG. 11 shows the inflated balloon 1 still connected to the canister 16 through the flexible tubing 12. In FIG. 12, the balloon has been released, the balloon including reflective streamers 10.

Accordingly, in the event of an emergency, the balloon is removed from its storage pouch 3 or other storage compartment, to which it may remains attached by the tether 18. The pouch 13 or any other body to which the balloon is attached should have sufficient weight to resist the buoyant force of the balloon, thus serving as an anchor. The tether 18 is stored in the pouch, and has sufficient length so that the balloon reaches sufficient altitude for easy detection, for example, a length of at least 100 feet, preferably at least 200 feet. Canister 16 includes a buoyant, lighter than air fluid, for example, helium gas, which is stored under pressure in the canister 16. Immediately following inflation, the balloon is still attached to the canister by the flexible tube 12, from which it is released optionally by the use of a quick-disconnect or by severing the tube with a cutter which may be included in the kit. The inflated balloon is then free to rise to an altitude which is determined by the length of the tether.

Optionally other sources of buoyant fluid may be used, as for example the generation of hydrogen from the reaction of lithium hydride and water. Regardless of the source of buoyant fluid, the chance of excessive inflation can be minimized by the use of an appropriate safety valve or by limiting the quantity of buoyant fluid at its source. At its deployment altitude, the balloon is restrained and capable of responding to an interrogating radar signal.

While the invention has been described with reference to preferred embodiments, it will be understood by those skilled in the art that various changes may be made and equivalents may be substituted for elements thereof without departing from the scope of the invention. In addition, many modifications may be made to adapt a particular situation of material to the teachings of the invention without departing from the scope of the invention. Therefore, it is intended that the invention not be limited to the particular embodiments disclosed as the best mode contemplated for carrying out this invention, but that the invention will include all embodiments falling within the scope and spirit of the appended claims.

What is claimed:

1. A radar detectable balloon device comprising an inflatable radar reflective envelope, wherein when inflated the envelope is formed by at least six radar reflective planar faces arranged in such a way that the largest angle formed by any line of sight and a normal to at least one planar face is less than 45°.

2. The device of claim 1, wherein the envelope includes two chambers, and when the envelope is inflated, each chamber includes at least four planar faces.

3. The device of claim 2, wherein the envelope includes two opposing polyhedral chambers.

4. The device of claim 3, wherein the two polyhedral chambers share a common apex.

5. The device of claim 3, wherein the two chambers have pyramidal configurations.

6. The device of claim 5, wherein the two pyramidal chambers are joined at or near an apex of side facets of the pyramidal chambers.

7. The device of claim 6, wherein the two chambers are fluidly connected.

8. The device of claim 6, wherein proximate pairs of edges of the pyramidal side facets are joined by radar reflective webbing.

9. The devices of claim 5, wherein the two chambers have square pyramidal configurations.

10. The device of claim 1, wherein the envelope includes a valve opening for introducing fluid therein.

11. A kit comprising the balloon device of claim 1, and an inflator for selectively inflating the envelope with lighter than air fluid.

12. The kit of claim 11, further comprising a tether connected to the balloon device, and a storage pouch for storing the balloon device in a deflated condition, the inflator, and the tether.

13. The kit of claim 12, further comprising streamers which depend from the tether in a plurality of locations along its length.

14. The kit of claim 12, wherein the storage pouch has a weight that is greater than the buoyancy force of balloon device when inflated with the lighter than air fluid.

15. The kit of claim 10, wherein the inflator includes a canister filled with the lighter than air fluid.

16. A radar detectable balloon device comprising an inflatable radar reflective envelope, wherein when inflated the envelope is defined by at least eight radar reflective planar faces.

17. The device of claim 16, wherein the envelope includes two chambers, and when the envelope is inflated, each chamber includes at least four planar faces.

18. The device of claim 17, wherein the two chambers have pyramidal configurations.

19. The device of claim 18, wherein the two pyramidal chambers are joined at or near an apex of side facets of the pyramidal chambers.

20. The device of claim 19, wherein the two chambers have square pyramidal configurations.

21. The device of claim 20, wherein the two chambers are fluidly connected.

22. The device of claim 20, wherein proximate pairs of edges of side facets of the pyramidal chambers are joined by radar reflective webbing.

23. The device of claim 16, wherein the envelope includes a valve opening for introducing fluid therein.

24. A radar detectable device, comprising:

(a) an inflatable radar reflective envelope moveable between a collapsed configuration and an inflated configuration, the envelope at least partially defined by a plurality of planar faces formed of a radar reflective material.

* * * * *